US008529269B2

(12) United States Patent
Coulombe

(10) Patent No.: US 8,529,269 B2
(45) Date of Patent: Sep. 10, 2013

(54) SWIM HARNESS FOR INSTRUCTION

(76) Inventor: Caitlin Coulombe, Warwick, RI (US)

( * ) Notice: Subject to any disclaimer, the term of this patent is extended or adjusted under 35 U.S.C. 154(b) by 0 days.

(21) Appl. No.: 13/399,538

(22) Filed: Feb. 17, 2012

(65) Prior Publication Data

US 2012/0208159 A1 Aug. 16, 2012

Related U.S. Application Data

(63) Continuation-in-part of application No. 13/024,596, filed on Feb. 10, 2011.

(51) Int. Cl.
*A63B 69/10* (2006.01)

(52) U.S. Cl.
USPC ..... 434/254

(58) Field of Classification Search
USPC ..... 434/247, 253–255; 441/88, 106, 441/113, 115; 482/55
See application file for complete search history.

(56) References Cited

U.S. PATENT DOCUMENTS 1,759,711 A * 5/1930 Price ..... 441/113
3,988,020 A * 10/1976 Carter ..... 482/55
4,276,670 A * 7/1981 Marchello et al. ..... 441/115
4,308,629 A 1/1982 Freemon
4,986,786 A * 1/1991 Helt et al. ..... 441/120
5,236,404 A * 8/1993 MacLennan ..... 482/55
5,342,232 A 8/1994 Bardot
5,348,504 A * 9/1994 Pierce et al. ..... 441/113
5,435,272 A 7/1995 Epstein
5,588,891 A * 12/1996 Bardot ..... 441/115
5,632,235 A * 5/1997 Larsen et al. ..... 119/856
5,766,114 A * 6/1998 Campbell ..... 482/55
6,251,049 B1 * 6/2001 Milton ..... 482/55
6,338,699 B1 1/2002 Veitch
6,712,741 B1 * 3/2004 McDonald ..... 482/111
7,104,932 B1 * 9/2006 Brentlinger ..... 482/57
7,331,836 B1 * 2/2008 Harris ..... 441/88
D583,894 S * 12/2008 Weedman et al. ..... D21/803
8,262,426 B1 * 9/2012 Barbis ..... 441/88
2005/0239027 A1 * 10/2005 Streeter et al. ..... 434/253
2006/0014448 A1 1/2006 Severino

* cited by examiner

*Primary Examiner* — Kurt Fernstrom

(57) ABSTRACT

A swim instruction harness comprising an adjustable support band that fastens around a child's torso with a loop handle for a caregiver to hold the child. An adjustable strap between the legs is attached to the adjustable support band, thus allowing the caregiver to hold the child in a horizontal body position in the water without being in the child's way. The harness gives the child needed support while also challenging the child to use its own strength and buoyancy to swim.

14 Claims, 5 Drawing Sheets

SWIM HARNESS FOR INSTRUCTION

This is a Continuation-In-Part of U.S. patent application Ser. No. 13/024,596 filed on Feb. 10, 2011 and priority is claimed thereto.

FIELD OF THE INVENTION

The present invention is a swim instruction harness comprising an adjustable support band that fastens around a child's torso with a loop handle for a caregiver to hold the child. An adjustable strap between the legs is attached to the adjustable support band, thus allowing the caregiver to hold the child in a horizontal body position in the water without being in the child's way. The harness gives the child needed support while also challenging the child to use its own strength and buoyancy to swim.

BACKGROUND OF THE INVENTION

The present invention relates to a swim instruction harness for teaching and assisting a child to swim, wherein an adjustable support band that encircles the child's torso area is connected to an adjustable strap between the legs. Also attached to the adjustable support band is a handle for a caregiver to hold in order to support the child in the water.

Swimming aids are essential tools during the process of learning to swim. They support children in the water and help them learn to control their body to keep above water. There are different types of swimming aids that serve different purposes. For instance, babies cannot rely on their own body strength and need a more sophisticated support such as float suits or float seats. Children who are already able to walk and are learning how to paddle can use inflatable armbands, back bubbles, kick boards, or foam barbells. All of the swim instruction tools used today are inflatable or made of foam, therefore making them flotation devices. The problem with flotation devices is that they obstruct a child's movement in the water and hinder the child from feeling its own buoyancy, which is a key component of learning to swim. Most swimming aids give the child too much help, which lengthens the process of learning to swim.

There is a certain type of swim instruction device that can be adapted to the skill level of the non-swimmer or beginning swimmer. This particular type of device is made of several foam float layers, which can be removed one by one so that the child gradually feels its own buoyancy and holds its own body weight above water. The drawbacks to this device are that the swimmer can still keep above water with hardly any effort at all and the device restricts the movements of the swimmer.

Traditionally, before flotation devices were invented, the hand on head hold technique was the most efficient way to teach children how to swim. The hand on head hold technique challenges children to use more strength and float on their own while giving them the perfect amount of support. The major flaws in this technique are that the instructor's arm gets in the way of the child, it is uncomfortable for the instructor and the child, the child struggles to attain horizontal body position, and it is difficult for the instructor to master the technique.

Therefore, there is a need for a swim instruction device like the present invention, which is not a flotation device, does not restrict the child's movements, and allows for support by an instructor.

U.S. Pub. No. 2006/0014448 for "Handheld Harness to Teach and Assist a Child in Swimming" by Severino, published on Jan. 19, 2006, is a swimming aid designed to help a child learn how to swim. Severino employs a mesh panel with a border connected to two loop handles. The child is placed upon the mesh panel in the water, and the handles are held by the instructor to support the child. Unlike the present invention, Severino's device does not snugly fasten to the child's torso, but necessitates the instructor maintaining a continual grip on the loop handles in order to keep the device firmly secured to the child. Severino's device also requires the child's arms to be fit through the loop handles, consequently exerting pressure on the child's shoulders and neck.

U.S. Pat. No. 4,308,629 for "Safety Harness Device," issued to Freemon on Jan. 5, 1982, is a safety harness device for supporting a person in the water for swimming instruction. Unlike the present invention, Freemon employs a pair of shoulder straps designed to extend over a child's shoulders and a pair of leg straps designed to extend around a child's legs.

U.S. Pat. No. 6,338,699 for "Child Sport Activity Training Device," issued to Veitch on Jan. 15, 2002, is a child sport activity training device with a torso harness, waist belt, back straps and a hand grip. Unlike the present invention, Veitch was initially developed for ice skating and is most suited in design for supporting a child engaged in activities in which the child's body is in a vertical position.

U.S. Pat. No. 5,435,272 for "Support Harness for a Young Child," issued to Epstein on Jul. 25, 1995 is a harness designed to keep a baby or young child in a safe vertical position in order to facilitate the process of walking. Unlike the present invention, Epstein is specifically designed to support a child in a vertical position, has straps that go around a child's legs, and has a handle for a caregiver placed above the child's head.

U.S. Pat. No. 5,342,232 for "Swim Training Device," issued to Bardot on Aug. 30, 1994 is a device for teaching children to swim that employs a pair of pouches that hold a plurality of removable flotation cells or panels. Bardot's invention positions one pouch over the swimmer's chest area and one pouch over the swimmer's back area. Unlike the present invention, Bardot employs flotation cells, whereas the present invention does not employ any flotation cells whatsoever.

U.S. Pat. No. 5,588,891 is for "Swim Training Device," issued to Bardot on Dec. 31, 1996, is a swim training device that includes a pair of buoyancy units that are interconnected jackets adapted to store a plurality of flotation cells. Unlike the present invention, Bardot employs flotation cells, whereas the present invention does not employ any flotation cells whatsoever.

SUMMARY OF THE INVENTION

The present invention is designed to help teach a child to swim by giving the child the perfect amount of support at all stages of instruction. Designed without shoulder straps or leg straps in order not to impede the child's movement, it ensures the child learns proper balance and horizontal body position in the water. The present invention is simple, inexpensive and easy-to-use, allowing an instructor to support the child in the water while still affording the child a natural swimming experience.

The present invention is strong enough to comfortably support the weight of a child in water without flotation devices and without restricting mobility. An adjustable support band encircles the child's torso, serving as a harness that enables full contact of the child's torso with the water. This adjustable support band can be easily placed by the instructor onto the child's torso and then tightened to keep it in place. Fastened to the adjustable support band is a handle loop for the instructor to hold in order to support the child's torso while giving the child a natural swimming experience. The present invention also provides an adjustable strap that passes between the child's legs and is connected to the adjustable support band in two places, with one end of the adjustable strap fastened to the front of the harness, and the other end of the adjustable strap fastened to the rear of the harness.

The present invention challenges beginning swimmers to use their own strength and feel their own buoyancy while learning to maintain horizontal body position in the water. The device gives a child the freedom to swim without the instructor being in the way, and is made without any means of flotation so that the child can feel its own buoyancy and be challenged to use its own strength to keep above the water. The instructor's resistance on the attached handle gives support that can be gradually reduced as the child progresses in ability. The device's simple design and construction make it easy to use and maintain while affording a natural swimming experience for the child and helping the caregiver teach the child to swim in an effective way.

DETAILED DESCRIPTION OF THE PRESENT INVENTION

Figure 1:
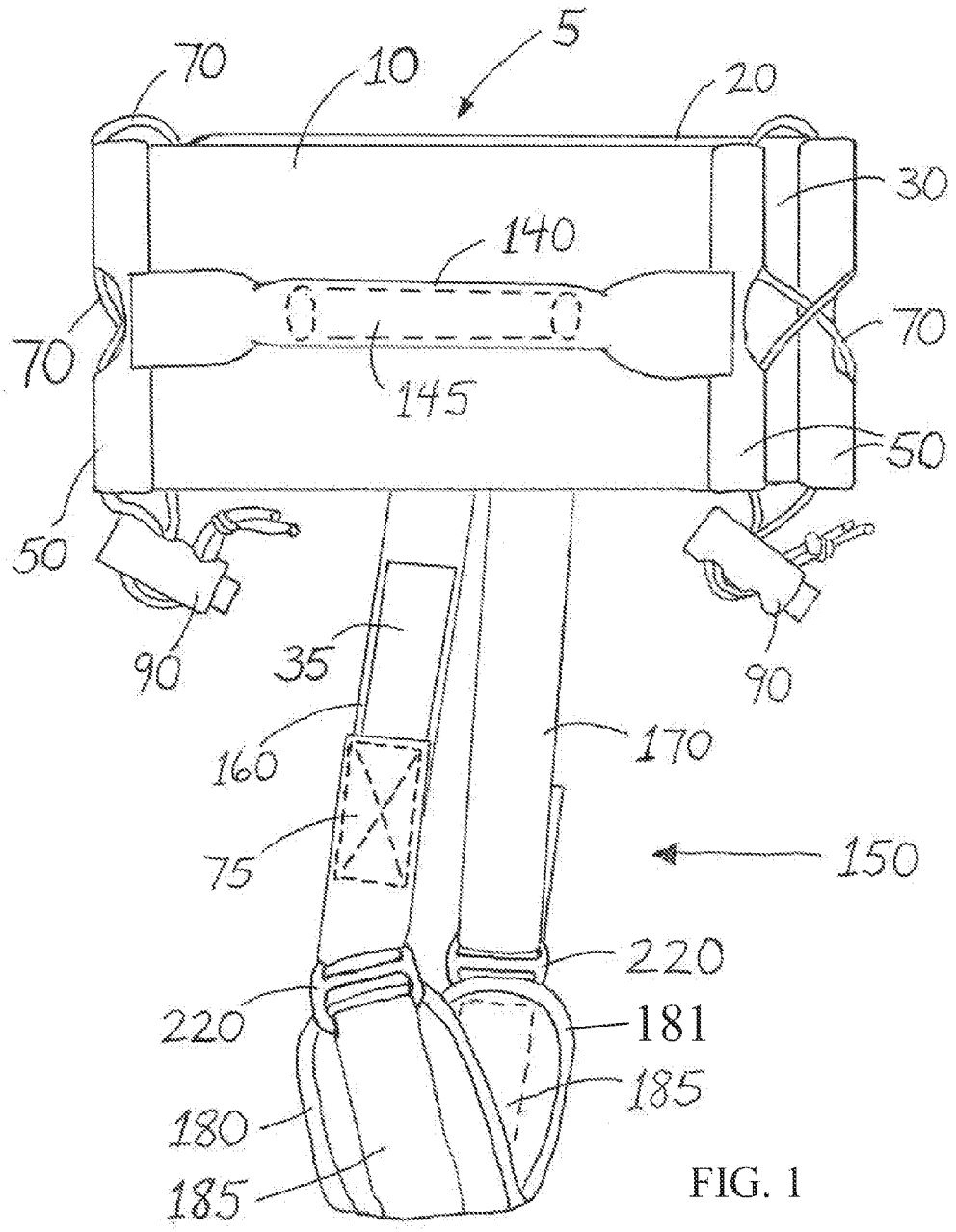
FIG. 1 shows an illustration of the first embodiment of the present invention.
Figure 2:
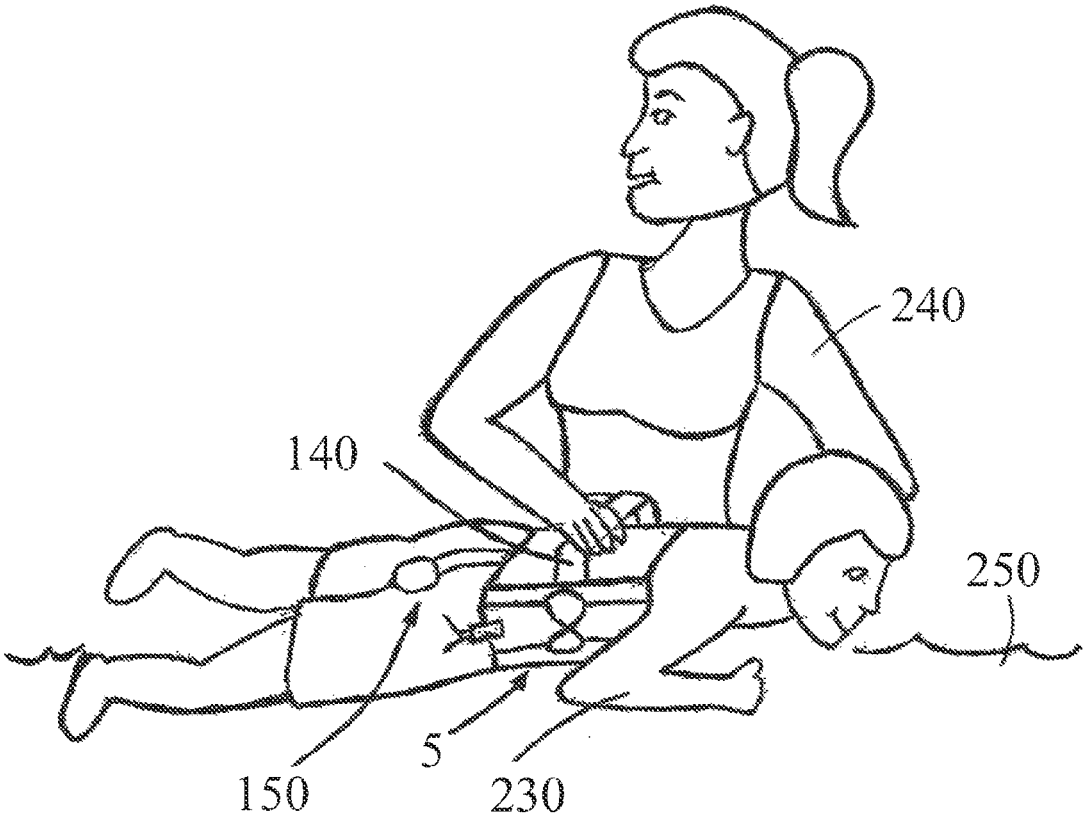
FIG. 2 shows an illustration of the first embodiment of the present invention in use.
Figure 3:
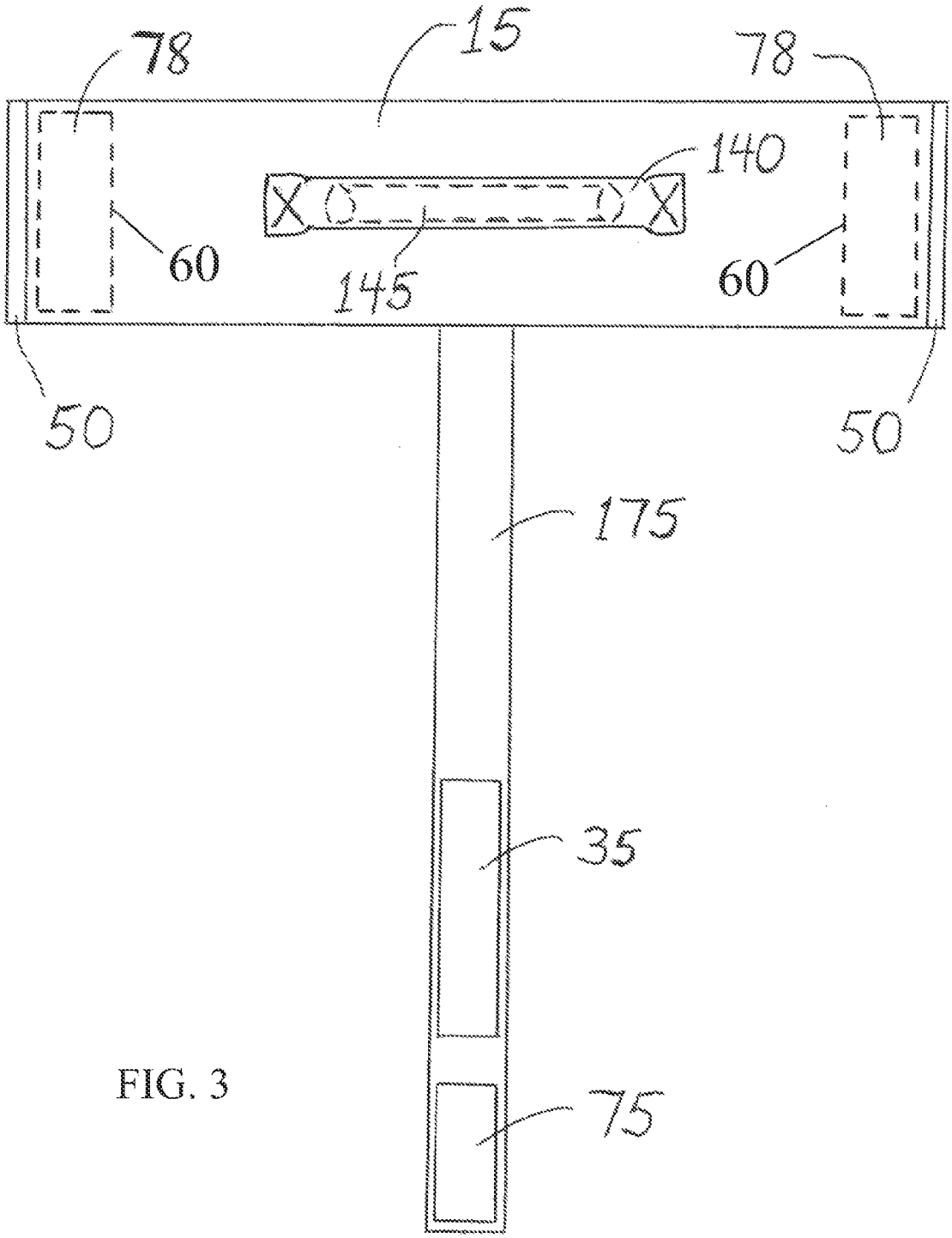
FIG. 3 depicts a view of the exterior side of the third panel (15) and its attached fourth strap (175) in the second embodiment of the present invention.
Figure 4:
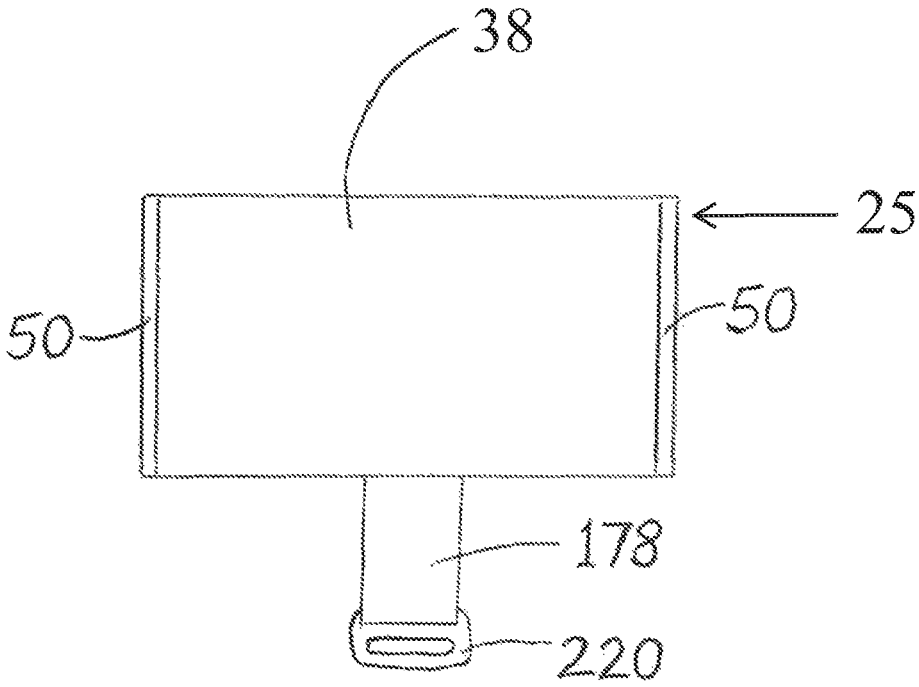
FIG. 4 depicts a view of the exterior side of the fourth panel (25) and its attached fifth strap (178) in the second embodiment of the present invention.
Figure 5:
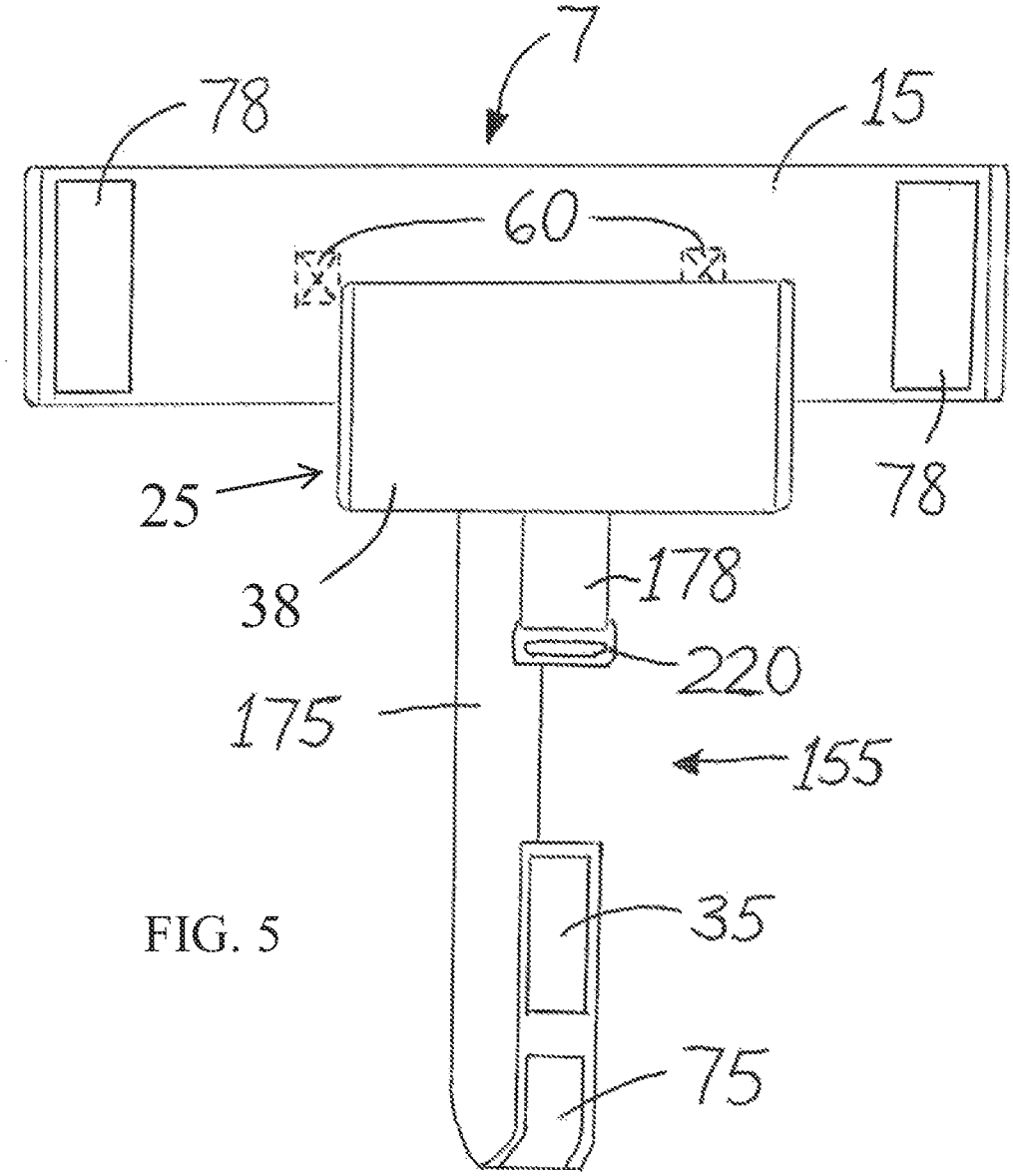
FIG. 5 depicts the joining together of the components shown in FIG. 3 and FIG. 4 to create the second adjustable support band (7) and second strap system (155) of the second embodiment of the present invention.

The present invention is a swim harness designed to help teach a child to swim. The figures depict two embodiments of the present invention, as described below. FIG. 1 and FIG. 2 depict the first embodiment of the present invention, and FIG. 3, FIG. 4 and FIG. 5 depict the second embodiment of the present invention.

Please note that throughout the following detailed description, the terms "interior side" and "exterior side" are employed with reference to some of the components of the present invention. The term "interior side" is used to refer to those portions of the components that come into direct contact with the torso of the child wearing the present invention. The term "exterior side" refers to those portions of the components that do not come into direct contact with the torso of the child wearing the present invention. In addition, the components of the present invention are primarily attached to each other by means of conventional stitching, the reasons being that stitching components together is a process that is inexpensive, easy to accomplish, and durable.

FIG. 1 shows an illustration of the first embodiment of the present invention. The main components of the first embodiment are a first adjustable support band (5) and a first strap system (150). Within this first adjustable support band (5) and first strap system (150) are the components that make up the first embodiment of the present invention.

At the summit of the first embodiment of the present invention shown in FIG. 1, is the first adjustable support band (5) that will be fitted to the torso of a child. This first adjustable support band (5) comprises two fabric panels, a first panel (10) and a second panel (20), that are joined together as described below. Both the first panel (10) and second panel (20) are identical, except that the first panel (10) has an attached handle (140). Both panels have a conventional mesh lining (30) attached on their interior sides by means of stitching, although other means of attachment could be used. The mesh lining (30) is used as an interfacing that adds body to the fabric and strengthens the edges of the first panel (10) and second panel (20) by making the fabric thicker and more rigid.

Side panels (50) are attached to the far left and far right edges of both the first panel (10) and the second panel (20) by means of stitching, although other means of attachment could be used. The side panels (50) are made of thick coated nylon with holes in the top, center and bottom through which bungee cords (70) are threaded in order to join the first and second panels (10 and 20) to form the first adjustable support band (5), and give the user the ability to tighten the first adjustable support band (5) around the torso of the child. Once an adjustable fit is made, the bungee cords (70) are secured in place by means of conventional slide toggles (90) placed on the bungee cords (70).

A key part of the first adjustable support band (5) is the handle (140) that is held by the instructor when teaching the child to swim. The handle (140), as shown in FIG. 1, is attached to the first panel (10) on its exterior side in a horizontal position by means of stitching, although other means of attachment could be used. The handle (140) is centered on the exterior side of the first panel (10). The handle (140) is envisioned as made of a hollowed cloth material with cylindrical tubing (145) (shown in dashed lines in FIG. 1) of rubber or other material placed within, so that it can be comfortably gripped by an instructor. It should be noted, however, that other conventional materials may be employed to construct the handle (140). It should also be noted that other embodiments of the present invention may attach the handle (140) to the exterior side of the first panel (10) in a vertical position (not shown), and still other embodiments may also place an additional handle on the exterior side of the second panel (20) in either a horizontal or vertical position (not shown). This would place a handle (140) on the front of the child wearing the present invention, as well as an additional handle on the rear of the child wearing the present invention. This construction would enable the instructor to easily assist the child in swimming on both the front and back of the body.

The other key component of the first embodiment of the present invention is the first strap system (150) that is worn between the legs of the child. The first strap system (150) has three main sections: a first strap (160), a second strap (170) identical to the first strap (160), and a third strap (185) attached to a pad (180). One end of the first strap (160) is attached to the midpoint of the bottom edge of the first panel (10) by means of stitching, although other means of attachment could be used. In addition, one end of the second strap (170) is attached to the midpoint of the bottom edge of the second panel (20) by means of stitching, although other means of attachment could be used. Conventional hook and loop fasteners, in the form of a strap loop fastener (35) and a strap hook fastener (75) (shown in dashed lines in FIG. 1), are attached to the first strap (160) by means of stitching, although other means of attachment could be used. (The first strap (160) and the second strap (170) being identical, the second strap (170) also has an attached strap loop fastener (35) and strap hook fastener (75), although they are not shown in FIG. 1.) Both the first strap (160) and the second strap (170) fasten to conventional Tri-Glide fasteners (220) by means of the strap loop fasteners (35) and strap hook fasteners (75). These Tri-Glide fasteners (220) are also fastened to the third strap (185) that is attached to the pad (180) by means of stitching, although other means of attachment could be used. The pad (180) is made of an oblong piece of neoprene fabric with a conventional nylon lycra border (181).

In order to use the present invention, it must be placed on the child's torso. First, the slide toggles (90) should be adjusted to loosen the bungee cords (70) so that the first adjustable support band (5) can be placed onto the child's torso, with the first strap system (150) placed between the child's legs. The bungee cords (70) should then be tightened and the slide toggles (90) adjusted so that the first adjustable support band (5) is secured to the child's torso. The first strap system (150) is fitted between the child's legs by means of the strap hook fasteners (75) and strap loop fasteners (35) so that the pad (180) sits comfortably under the child's crotch area. The child can then be placed in a body of water while the instructor grasps the handle (140) to support the child and maintain the optimal amount of resistance to keep the child on top of the water.

FIG. 2 shows an illustration of the first embodiment of the present invention in use. A child (230) is shown lying face down on a water surface (250) while an instructor (240) holds the handle (140) of the present invention. The first adjustable support band (5) of the present invention is shown fitted to the torso of the child, and the first strap system (150) of the present invention is shown worn between the child's legs.

FIG. 3, FIG. 4 and FIG. 5 depict the second embodiment of the present invention. FIG. 3 depicts a view of the exterior side of the third panel (15) and its attached fourth strap (175), FIG. 4 depicts a view of the exterior side of the fourth panel (25) and its attached fifth strap (178), and FIG. 5 depicts the joining together of the components shown in FIG. 3 and FIG. 4 to create the second adjustable support band (7) and second strap system (155) of the second embodiment of the present invention.

FIG. 3 depicts a view of the exterior side of the third panel (15) and its attached fourth strap (175) in the second embodiment of the present invention. The third panel (15) is comprised of conventional stretch elastic material in order that it can be adjusted to fit around the torso of a child. A handle (140) is attached to the exterior side of the third panel (15) by means of stitching, although other means of attachment could be used. The handle (140) is centered in a horizontal position on the exterior side of the third panel (15), although other embodiments of the present invention may center the handle (140) in a vertical position on the exterior side of the third panel (15). As in the first embodiment described above, the handle (140) is envisioned as hollowed cloth material with cylindrical tubing (145) (shown in dashed lines in FIG. 3) of rubber or other material placed within, so that the instructor can comfortably grip the handle (140). It should be noted, however, that other conventional materials can be employed to construct the handle (140). Side panels (50) are attached to the far left and far right edges of the third panel (15) by means of stitching, although other means of attachment could be used. The side panels (50) are made of strips of thick coated nylon, and adjacent to the side panels (50) are two strips of conventional hook fastener material, called here panel hook fasteners (78). The panel hook fasteners (78) are attached to the third panel (15) on its interior side (not shown in FIG. 3, see FIG. 5), so FIG. 3 shows the thread (60) that indicates where the panel hook fasteners (78) are attached to the third panel (15) by means of stitching, although other means of attachment could be used. The fourth strap (175) is attached to the bottom center of the third panel (15) by means of stitching, although other means of attachment could be used. Conventional hook and loop fasteners in the form of a strap loop fastener (35) and a strap hook fastener (75) are attached to the fourth strap (175) by means of stitching, although other means of attachment could be used.

FIG. 4 depicts a view of the exterior side of the fourth panel (25) and its attached fifth strap (178) in the second embodiment of the present invention. The fourth panel (25) is comprised of conventional fabric with a strip of conventional loop fastener material, called here a panel loop fastener (38), attached to its exterior side and side panels (50) attached to its left and right edges. The panel loop fastener (38) is attached to the fourth panel (25) by means of stitching, although other means of attachment could be used. The side panels (50) are made of strips of thick coated nylon and are attached to the left and right edges of the fourth panel (25) by means of stitching, although other means of attachment could be used. One end of the fifth strap (178) is attached to the bottom center of the fourth panel (178) by means of stitching, although other means of attachment could be used. The opposite end of the fifth strap (178) is attached to a conventional Tri-Glide fastener (220) by means of stitching, although other means of attachment could be used.

FIG. 5 depicts the joining together of the components shown in FIG. 3 and FIG. 4 to create the second adjustable support band (7) and second strap system (155) of the second embodiment of the present invention. FIG. 5 shows a view of the exterior side of the fourth panel (25) and a view of the interior side of the third panel (15). The view of the interior side of the third panel (15) in FIG. 5 shows the thread (60) that indicates where the handle (140) (not shown in FIG. 5, see FIG. 3) was stitched to the third panel (15) on its exterior side (not shown in FIG. 5, see FIG. 3). The panel hook fasteners (78) of the third panel (15) wrap around the torso of the child to connect to the panel loop fastener (38) of the fourth panel (25) to form the second adjustable support band (7) that will be fitted around the torso of a child. At the base of the second embodiment of the present invention shown in FIG. 5, the fourth strap (175) threads through the Tri-Glide fastener (220) and fastens to it by means of the strap hook fastener (75) and strap loop fastener (35) in order to form the second strap system (155) that will be fitted between the legs of the child.

It should be noted that although the second embodiment as described above uses conventional hook fastener material on the third panel (15) and conventional loop fastener material on the fourth panel (25) in order to join the third panel (15) and fourth panel (25) together, another embodiment of the present invention could employ conventional loop fastener material on the third panel (15) and conventional hook fastener material on the fourth panel (25) in order to join the third panel (15) and fourth panel (25) together.

Additionally, it should be understood that the first adjustable support band (5) described above is a part of the first embodiment of the present invention, and that the first adjustable support band (5) can also be a cylindrical member. In the same way, it should be understood that the first strap system (150) described above is a part of the first embodiment of the present invention, and that the first strap system (150) can also be a strap.

It should also be understood that the second adjustable support band (7) described above is a part of the second embodiment of the present invention, and that the second adjustable support band (7) can also be a cylindrical member. In the same way, it should be understood that the second strap system (155) described above is a part of the second embodiment of the present invention, and that the second strap system (155) can also be a strap.

In summary, the present invention is a swim harness, comprising a cylindrical member; a handle (140), the handle (140) in communication with the cylindrical member; a strap, the strap in communication with the cylindrical member; wherein the cylindrical member is a third panel (15) and a fourth panel (25); wherein the cylindrical member is held together with a panel loop fastener (38) and a panel hook fastener (78); wherein the handle (140) is in communication with an exterior side of the cylindrical member; wherein the handle (140) extends inline along a curve of the cylindrical member; wherein the strap is comprised of a fourth strap (175) and a fifth strap (178); and wherein the strap extends in a perpendicular direction from a curve of the cylindrical member.

The invention claimed is:

1. A swim harness, comprising:
- a first panel;
- a second panel;
- wherein said first panel is rectangular in shape;
- wherein said first panel and said second panel are arranged to form a cylindrical member;
- wherein said first panel and said second panel are bound together;
- a handle, said handle in communication with said cylindrical member;
- a strap, said strap in communication with said cylindrical member;
- a pad, in communication with said strap; and
- wherein said pad, said strap, said handle, said cylindrical member, said first panel and said second panel do not provide flotation.

2. The swim harness of claim 1, wherein said cylindrical member is held together with a panel loop fastener and a panel hook fastener.

3. The swim harness of claim 2, wherein said handle is in communication with an exterior side of said cylindrical member.

4. The swim harness of claim 3, wherein said handle extends inline along a curve of said cylindrical member.

5. The swim harness of claim 2, wherein said handle extends inline along a curve of said cylindrical member.

6. The swim harness of claim 1, wherein said handle is in communication with an exterior side of said cylindrical member.

7. The swim harness of claim 6, wherein said handle extends inline along a curve of said cylindrical member.

8. The swim harness of claim 1, wherein said handle extends inline along a curve of said cylindrical member.

9. The swim harness of claim 1, wherein said strap is comprised of a first strap and a second strap.

10. The swim harness of claim 1, wherein said strap extends in a perpendicular direction from a curve of said cylindrical member.

11. A swim harness, comprising:
- a first panel;
- a second panel;
- wherein said first panel and said second panel are rectangular in shape;
- wherein said first panel and said second panel are arranged to form a cylindrical member;
- a handle, said handle in communication with said cylindrical member;
- a strap, said strap in communication with said cylindrical member;
- a pad, in communication with said strap;
- wherein said handle is in communication with a top portion of said cylindrical member;
- wherein said handle extends inline along a curve of said cylindrical member;
- wherein said pad is centered on said strap;
- wherein said strap is comprised of a first strap and a second strap; and
- wherein said strap extends in a perpendicular direction from a curve of said cylindrical member.

12. The swim harness of claim 1, wherein both said first panel and said second panel are rectangular in shape.

13. The swim harness of claim 11 wherein said first panel, said second panel, said strap, said pad, said handle, and said cylindrical member do not float.

14. A method for aiding the swimming education of a user with an instructor comprising:
- the instructor fastening a cylindrical member around the torso of the user;
- the instructor fastening a strap between the legs of the user;
- the instructor securing the cylindrical member to the user via a panel hook fastener and a panel loop fastener;
- wherein the cylindrical member is comprised of a first panel and a second panel;
- wherein the first panel is equipped with a handle and a strap;
- wherein the cylindrical member is not configured to float;
- the instructor centering the handle as high as possible on the back of the user, above the center of gravity of the user;
- the instructor and the user entering a body of water together;
- the instructor holding the handle firmly as the user is suspended in the body of water, providing resistance and support of the user by keeping the user at water level; and
- the instructor gradually reducing resistance on the handle as increased competence of swimming of the user is achieved.

* * * * *